US012584073B2

(12) United States Patent
Qiu et al.

(10) Patent No.: US 12,584,073 B2
(45) Date of Patent: Mar. 24, 2026

(54) CLEAN COAL FOR COMBUSTION AND PREPARATION METHOD THEREOF

(71) Applicants: Ningbo Jiufeng Thermoelectricity Company Limited, Ningbo (CN); Ningbo Tech University, Ningbo (CN)

(72) Inventors: Dan Qiu, Ningbo (CN); Junting Ye, Ningbo (CN); Feiyu Tang, Ningbo (CN); Junchun Ren, Ningbo (CN); Bin Li, Ningbo (CN); Yiting Zhou, Ningbo (CN); Fengshuang Han, Ningbo (CN); Ziwen Dong, Ningbo (CN); Mingyong Chen, Ningbo (CN); Yuefeng Zhong, Ningbo (CN)

(73) Assignees: Ningbo Jiufeng Thermoelectricity Company Limited, Ningbo (CN); Ningbo Tech University, Ningbo (CN)

( * ) Notice: Subject to any disclaimer, the term of this patent is extended or adjusted under 35 U.S.C. 154(b) by 0 days.

(21) Appl. No.: 18/884,107

(22) Filed: Sep. 13, 2024

(65) Prior Publication Data

US 2025/0382537 A1 Dec. 18, 2025

(30) Foreign Application Priority Data

Jun. 18, 2024 (CN) ..... 202410786318.0

(51) Int. Cl.

| | |
|---|---|
| ***C10L 5/14*** | (2006.01) |
| ***C10L 5/22*** | (2006.01) |
| ***C10L 10/00*** | (2006.01) |

(52) U.S. Cl.
CPC ..... *C10L 5/14* (2013.01); *C10L 5/22* (2013.01); *C10L 10/00* (2013.01)

(58) Field of Classification Search
CPC ..... C10L 5/14; C10L 5/22; C10L 10/00
See application file for complete search history.

(56) References Cited

FOREIGN PATENT DOCUMENTS

| | | | | |
|---|---|---|---|---|
| CN | 1699526 A | | 11/2005 | |
| CN | 101302000 A | * | 11/2008 | |
| CN | 108251174 A | | 7/2018 | |
| CN | 112831360 A | * | 5/2021 | ..... C10L 5/105 |

* cited by examiner

*Primary Examiner* — Latosha Hines

(57) ABSTRACT

The present disclosure relates to a clean coal for combustion and a preparation method thereof. The preparation method includes the following steps: (1) dispersing starch in water, uniformly stirring, and fully gelatinizing; (2) adding a sulfur-fixing agent into the gelatinization solution, and centrifuging to obtain the starch gelatinized solution containing the sulfur-fixing agent; (3) crushing the coal for combustion to obtain coal particles; and (4) conveying the coal particles to a fluidized bed, spraying the starch gelatinized solution containing the sulfur-fixing agent on the coal particles in a suspension state, and drying to obtain coal particles adsorbed with the sulfur-fixing agent and gelatinized starch. According to the present disclosure, the starch gelatinized solution is used to dissolve the soluble sulfur-fixing agent, and then the starch solution is adsorbed in-situ into the coal particles, so that the soluble sulfur-fixing agent is uniformly adsorbed in the coal for combustion.

9 Claims, 1 Drawing Sheet

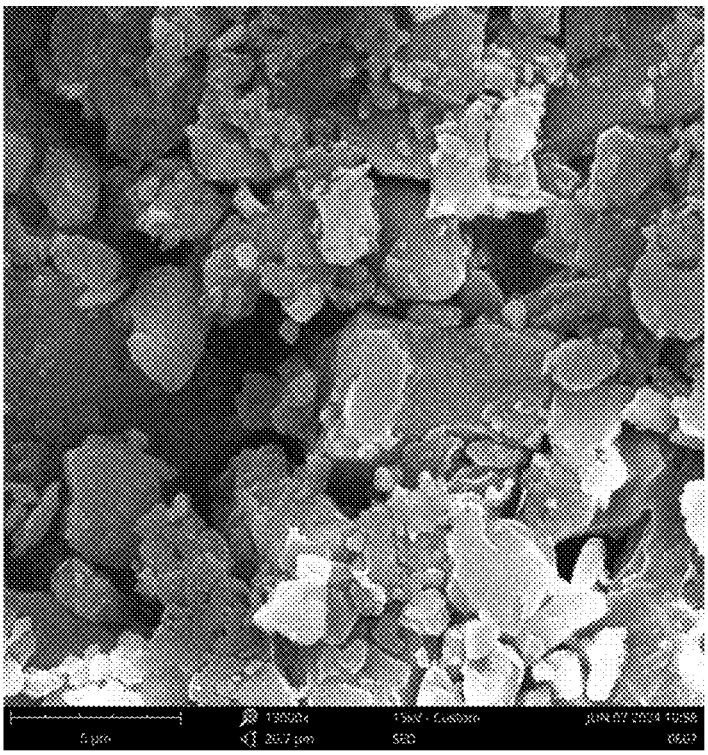
5 µm
15000x
Chem - Carbon
JUN 07 2024 10:58
20.7 µm
SED
0607

CLEAN COAL FOR COMBUSTION AND PREPARATION METHOD THEREOF

CROSS-REFERENCE TO RELATED APPLICATION

The present application claims priority from Chinese Patent Application No. 202410786318.0 filed on Jun. 18, 2024, the contents of which are incorporated herein by reference in their entirety.

TECHNICAL FIELD

The present disclosure belongs to the technical field of coal products, and particularly relates to a clean coal for combustion and a preparation method thereof.

BACKGROUND

As China's primary energy source, coal combustion generates $SO_2$, which causes severe air pollution. Therefore, how to utilize coal resources cleanly and efficiently has always been a critical technical issue.

Coal desulfurization can be divided into pre-combustion desulfurization, in-combustion desulfurization, and post-combustion desulfurization.

Pre-combustion desulfurization involves removing sulfur from coal before combustion to prevent or reduce the release of $SO_2$ during the combustion process, thereby mitigating corrosion of flues and environmental pollution. For instance, physical coal washing is a pre-combustion desulfurization technology that is simple to operate and low in cost, but it can often only remove most of the inorganic sulfur.

In-combustion desulfurization (sulfur fixation) typically involves adding sulfur-fixing agents or additives to the furnace during the coal combustion process at 800-850° C., enabling the $SO_2$ generated by coal combustion to react chemically with the sulfur-fixing agents, forming non-decomposable sulfur-fixed products that are subsequently discharged in the form of solid ash. Commonly used sulfur-fixing agents include $CaCO_3$, CaO, MgO, among others. Current issues with this technology include susceptibility to slagging, wear, and clogging, as well as higher costs and reduced boiler efficiency. Given the limited sulfur fixation effect under high-temperature conditions, it is crucial to select appropriate sulfur-fixing agents tailored to specific coal types.

Post-combustion desulfurization, also known as flue gas desulfurization, refers to the desulfurization of flue gas generated after coal combustion. This method can be further categorized into discard methods and recovery methods based on whether the product is recycled. While offering high desulfurization rates, this method is complex and has significantly higher overall treatment costs compared to other technologies.

The sulfur fixation mechanism of sulfur-fixing agents used in coal combustion is as follows: During the high-temperature combustion of coal, $SO_2$ or $SO_3$ is generated. The sulfur-fixing agents, such as calcium-based, magnesium-based, and barium-based agents, decompose under high-temperature conditions to produce metal oxides. The sulfur fixation reaction occurs between $SO_2$ or $SO_3$ and these metal oxides, ultimately forming sulfates or sulfites.

The Chinese patent CN1699526A discloses a coal combustion and sulfur fixation composite additive, which comprises (by mass percent) CaO 36-74%, BaCO3 26-64%. In addition, the additive can also contain one or more selected from $Al_2O_3$, $KMnO_4$, $MnO_2$. According to the coal combustion and sulfur fixation composite additive, it exhibits good high-temperature sulfur fixation efficiency, achieving a sulfur fixation efficiency of 70% or above within the temperature range of 900-1100° C., and reaching 40%-70% sulfur fixation efficiency at the high temperatures of 1200-1300° C. However, the sulfur-fixing agent component contains insoluble components, which may cause non-uniformity during mixing, leading to poor sulfur fixation effects, significant coking, and consequently, reduced heat conduction efficiency of the boiler.

The Chinese patent CN108251174A discloses an environment-friendly sulfur-fixing coal briquette and a preparation method thereof. The environment-friendly sulfur-fixing coal briquette is prepared from the following materials in parts by weight: 50-60 parts of pulverized coal, 15-20 parts of coal slime, 10-20 parts of a sulfur-fixing additive and 5-10 parts of a binder; the sulfur-fixing additive is prepared from 45-50 parts of acetylene sludge powder, 1-10 parts of potassium permanganate, 5-15 parts of iron mine powder, 10-20 parts of magnesium oxide and 1-3 parts of sodium chloride; and the binder is prepared from 50-60 parts of lignin, 20-40 parts of bentonite and 5-10 parts of starch. The sulfur-fixing additive uses acetylene sludge as a main raw material, supplemented with a certain amount of iron mine powder, magnesium oxide, and sodium chloride, to enhance the high-temperature sulfur-fixing stability of acetylene sludge, improve the sulfur-fixing rate, and effectively reduce sulfur emissions from briquette combustion. Firstly, the disclosure seeks to protect a type of briquette, which is a finished coal product with certain strength, size, and various shapes formed through mechanical processing and pressing. However, briquettes are not suitable for large-scale coal consumption places such as power plant boilers, and there are issues with low combustion efficiency. Additionally, the sulfur-fixing agent used in this disclosure contains insoluble components, which cannot be well dispersed in pulverized coal, and starch is used as a binder in this disclosure to press pulverized coal into various shapes.

However, most of the existing sulfur-fixing agents are insoluble components, which will lead to uneven mixing with pulverized coal, resulting in poor sulfur fixation effect. Moreover, the addition of insoluble sulfur-fixing agents will cause coking, which will have a negative effect on the boiler, and also lead to the reduction of combustion efficiency. Therefore, it is necessary to develop a clean coal for combustion with good sulfur fixation effect, high combustion efficiency and no negative impact on the boiler and a preparation method thereof.

SUMMARY

In view of the deficiencies in the prior art, the present disclosure aims to provide a clean coal for combustion and a preparation method thereof. Specifically, the starch gelatinized solution is used to dissolve the soluble sulfur-fixing agent, so that the soluble sulfur-fixing agent is uniformly adsorbed in the coal for combustion. The sulfur in the coal for combustion is efficiently in-situ reaction with the adsorbed soluble sulfur-fixing agent, which can effectively improve the sulfur fixation effect. In addition, the starch solution is adsorbed in-situ into the coal particles, which can play a role of combustion-supporting, thereby effectively improving the combustion efficiency of the coal for combustion, and the clean coal for combustion in the present disclosure does not have any negative effect on the boiler.

In order to achieve the above-mentioned purpose, the present disclosure is realized through the following technical scheme:

On the one hand, the present disclosure provides a preparation method of a clean coal for combustion, comprising the following steps:

(1) dispersing starch in water and uniformly stirring to obtain a starch milk; and heating the starch milk to 70-100° C. and gelatinizing for 10-60 minutes to obtain a starch gelatinized solution;

(2) adding a sulfur-fixing agent into the starch gelatinized solution under a condition of controlling a temperature of the starch gelatinized solution at 30-60° C., and centrifuging to remove insoluble substances to obtain the starch gelatinized solution containing the sulfur-fixing agent;

(3) crushing the coal for combustion, and screening to obtain coal particles; and (4) conveying the coal particles to a fluidized bed, spraying the starch gelatinized solution containing the sulfur-fixing agent on the coal particles in a suspension state, and drying to obtain coal particles adsorbed with the sulfur-fixing agent and gelatinized starch.

A concentration of the starch milk in step (1) is 5-20 g/L; preferably 10-15 g/L.

The sulfur-fixing agent in the step (2) is a soluble sulfur-fixing agent; and the soluble sulfur-fixing agent is one or more of $Ba(OH)_2$, $Ca(HCO_3)_2$ and $Mg(HCO_3)_2$;

preferably, the soluble sulfur-fixing agent is a mixture of $Ba(OH)_2$, $Ca(HCO_3)_2$ and $Mg(HCO_3)_2$.

More preferably, a mass ratio of $Ba(OH)_2$, $Ca(HCO_3)_2$ and $Mg(HCO_3)_2$ is 1:2-5:1-3;

further preferably, the mass ratio of $Ba(OH)_2$, $Ca(HCO_3)_2$ and $Mg(HCO_3)_2$ is 1:3-4:2-3;

most preferably, the mass ratio of $Ba(OH)_2$, $Ca(HCO_3)_2$ and $Mg(HCO_3)_2$ is 1:4:2.

According to the present disclosure, a mixture of $Ba(OH)_2$, $Ca(HCO_3)_2$ and $Mg(HCO_3)_2$ in varying proportions is used as a sulfur-fixing agent. All three components are water-soluble, and when dissolved in a gelatinized starch solution, they form a uniformly dissolved solution. Spraying this solution onto coal particles enables the curing agent components to effectively adsorb into the pores of the coal for combustion, thereby increasing the contact area between the curing agent and the coal for combustion, and enhancing the sulfur fixation effect. Furthermore, the present disclosure adopts a mixed sulfur-fixing agent and controls the mass ratio of $Ba(OH)_2$, $Ca(HCO_3)_2$ and $Mg(HCO_3)_2$ at 1:2-5:1-3, enabling the fixation of $SO_2$ or $SO_3$ generated during different stages of coal combustion, resulting in an even more effective sulfur fixation performance.

A mass-to-volume ratio of the soluble sulfur-fixing agent and the starch gelatinized solution in step (2) is 5-15:1 (g/L);

preferably, the mass-to-volume ratio of the soluble sulfur-fixing agent and the starch gelatinized solution is 8-12:1 (g/L);

more preferably, the mass-to-volume ratio of the soluble sulfur-fixing agent and the starch gelatinized solution is 10:1 (g/L).

A particle size of the crushed coal particles in the step (3) is 5-200 μm.

In step (4), the starch gelatinized solution containing the sulfur-fixing agent is uniformly sprayed onto the coal for combustion at room temperature in a ratio of 3‰-5‰;

preferably, the starch gelatinized solution containing the sulfur-fixing agent is uniformly sprayed onto the coal for combustion at room temperature in the ratio of 4‰.

In step (4), a drying temperature is above 80° C.

As some preferred embodiments, in step (2), an amylase is further added, and an addition amount of the amylase is 3-6% of a mass of the starch; preferably 5%.

The amylase is selected from one or more of α-amylase, β-amylase, glucoamylase and isoamylase;

preferably, the amylase is β-amylase or/and isoamylase;

more preferably, the amylase is β-amylase or/and isoamylase in a mass ratio of 1:1.

An enzyme activity of the β-amylase is 50-100 U/g starch; and an enzyme activity of the isoamylase is 50-100 U/g starch.

According to the present disclosure, amylase is further added into the gelatinized starch solution. The addition of amylase not only facilitates the dispersion of the sulfur-fixing agent in the gelatinized starch solution but also enhances the flow rate of the starch gelatinized solution, enabling the sulfur fixative-laden gelatinized starch solution to rapidly penetrate into the interstices of coal particles. By employing a mixture of β-amylase and isoamylase, with a controlled mass ratio of 1:1, the dispersion of the components of the sulfur-fixing agent within the gelatinized starch solution is further optimized. Moreover, during the spraying process, the interaction between β-amylase, isoamylase, and the gelatinized starch ensures the fluidity and stability of the starch gelatinized solution, allowing the components of the sulfur-fixing agent to better permeate into the interior of the coal, thereby enhancing the sulfur fixation effectiveness of the sulfur-fixing agent.

Compared with the prior art, the beneficial effects of the present disclosure are:

(1) According to the present disclosure, a mixture of $Ba(OH)_2$, $Ca(HCO_3)_2$ and $Mg(HCO_3)_2$ in varying proportions is used as a sulfur-fixing agent. All three components are water-soluble, and when dissolved in a gelatinized starch solution, they form a uniformly dissolved solution. Spraying this solution onto coal particles enables the curing agent components to effectively adsorb into the pores of the coal for combustion, thereby increasing the contact area between the curing agent and the coal for combustion, and enhancing the sulfur fixation effect. Furthermore, the present disclosure adopts a mixed sulfur-fixing agent and controls the mass ratio of $Ba(OH)_2$, $Ca(HCO_3)_2$ and $Mg(HCO_3)_2$ at 1:2-5:1-3, enabling the fixation of $SO_2$ or $SO_3$ generated during different stages of coal combustion, resulting in an even more effective sulfur fixation performance.

(2) According to the present disclosure, the starch gelatinized solution is used to dissolve the soluble sulfur-fixing agent, and then the starch solution is adsorbed in-situ into the coal particles, so that the soluble sulfur-fixing agent is uniformly adsorbed in the coal for combustion. The sulfur in the coal for combustion is efficiently in-situ reaction with the adsorbed soluble sulfur-fixing agent, which effectively improves the combustion efficiency and sulfur fixation effect of the coal for combustion without having any negative effects on the boiler.

(3) According to the present disclosure, amylase is also added into the starch gelatinized solution. The addition of amylase, on the one hand, regulates the viscosity and molecular weight of the starch gelatinized solution, and on the other hand, it can improve the flow rate of the starch gelatinized solution, allowing the starch gelatinized solution containing the sulfur-fixing agent to quickly penetrate into the interstices of coal particles. By employing a mixture of β-amylase and isoamylase, with a controlled mass ratio of 1:1, the dispersion of the components of the sulfur-fixing agent within the gelatinized starch solution is further optimized. Moreover, during the spraying process, the interaction between β-amylase, isoamylase, and the gelatinized starch ensures the fluidity and stability of the starch gelatinized solution, allowing the components of the sulfur-fixing agent to better permeate into the interior of the coal, thereby enhancing the sulfur fixation effectiveness of the sulfur-fixing agent.

BRIEF DESCRIPTION OF THE DRAWINGS

The sole FIGURE is a Scanning Electron Microscope (SEM) image of a coal particle adsorbed with a sulfur-fixing agent and gelatinized starch prepared in Embodiment 1.

DETAILED DESCRIPTION OF THE EMBODIMENTS

In order to better explain the purpose, the technical solution and the advantages of the present disclosure, the present disclosure will be further described below with reference to specific embodiments. In the embodiment, the experimental methods used are conventional methods unless otherwise specified, and the materials and reagents used can be obtained from commercial sources unless otherwise specified.

Embodiment 1

A Preparation Method of a Clean Coal for Combustion

The preparation method for the clean coal for combustion, comprising the following steps:

(1) dispersing starch in water and uniformly stirring to obtain a starch milk with a concentration of 5 g/L; and fully gelatinizing the starch milk at 70° C. to obtain starch gelatinized solution;

(2) adding a sulfur-fixing agent into the starch gelatinized solution under a condition of controlling a temperature of the starch gelatinized solution at 30-60° C., where a mass-to-volume ratio of the soluble sulfur-fixing agent and the starch gelatinized solution is 5:1 (g/L), and centrifuging to remove insoluble substances to obtain a starch gelatinized solution containing the sulfur-fixing agent; and the sulfur-fixing agent is a mixture of $Ba(OH)_2$, $Ca(HCO_3)_2$ and $Mg(HCO_3)_2$, with a mass ratio of 1:2:1;

(3) crushing the coal for combustion, and screening to obtain coal particles, with an average particle size of the coal particles being 5 μm; and (4) conveying the coal particles to a fluidized bed, uniformly spraying the starch gelatinized solution containing the sulfur-fixing agent on coal for combustion at room temperature in a suspension state according to a proportion of 5‰, and drying at 80° C. to obtain coal particles adsorbed with the sulfur-fixing agent and gelatinized starch, as shown in the sole FIGURE.

Embodiment 2

A Preparation Method of a Clean Coal for Combustion

The preparation method for the clean coal for combustion, comprising the following steps:

(1) dispersing starch in water and uniformly stirring to obtain a starch milk with a concentration of 20 g/L; and fully gelatinizing the starch milk at 100° C. to obtain starch gelatinized solution;

(2) adding a sulfur-fixing agent into the starch gelatinized solution under a condition of controlling a temperature of the starch gelatinized solution at 30-60° C., where a mass-to-volume ratio of the soluble sulfur-fixing agent and the starch gelatinized solution is 15:1 (g/L), and centrifuging to remove insoluble substances to obtain a starch gelatinized solution containing the sulfur-fixing agent; and the sulfur-fixing agent is a mixture of $Ba(OH)_2$, $Ca(HCO_3)_2$ and $Mg(HCO_3)_2$, with a mass ratio of 1:5:3;

(3) crushing the coal, and screening to obtain coal particles, with an average particle size of the coal particles being 50 μm; and (4) conveying the coal particles to a fluidized bed, uniformly spraying the starch gelatinized solution containing the sulfur-fixing agent on coal for combustion at room temperature in a suspension state according to a proportion of 3‰, and drying at 100° C. to obtain coal particles adsorbed with the sulfur-fixing agent and gelatinized starch.

Embodiment 3

A Preparation Method of a Clean Coal for Combustion

The preparation method for the clean coal for combustion, comprising the following steps:

(1) dissolving starch in water and uniformly stirring to obtain a starch milk with a concentration of 10 g/L; and fully gelatinizing the starch milk at 90° C. to obtain starch gelatinized solution;

(2) adding a sulfur-fixing agent into the starch gelatinized solution under a condition of controlling a temperature of the starch gelatinized solution at 30-60° C., where a mass-to-volume ratio of the soluble sulfur-fixing agent and the starch gelatinized solution is 10:1 (g/L), and centrifuging to remove insoluble substances to obtain a starch gelatinized solution containing the sulfur-fixing agent; and the sulfur-fixing agent is a mixture of $Ba(OH)_2$, $Ca(HCO_3)_2$ and $Mg(HCO_3)_2$, with a mass ratio of 1:4:2;

(3) crushing the coal for combustion, and screening to obtain coal particles, with an average particle size of the coal particles being 200 μm; and (4) conveying the coal particles to a fluidized bed, uniformly spraying the starch gelatinization solution containing the sulfur-fixing agent on coal for combustion at room temperature in a suspension state according to a proportion of 4‰, and drying at 100° C. to obtain coal particles adsorbed with the sulfur-fixing agent and gelatinized starch.

Embodiment 4

The only difference from Embodiment 3 is that in step (2), an amylase is further added, an addition amount of the amylase is 5% of a mass of the starch, the amylase is β-amylase and isoamylase in a mass ratio of 1:1, and the other steps and operations are the same as in Embodiment 3.

Embodiment 5

The only difference from Embodiment 4 is that in step (2), an addition amount of the amylase is 3% of a mass of the starch, and the other steps and operations are the same as in Embodiment 4.

Embodiment 6

The only difference from Embodiment 4 is that in step (2), an addition amount of the amylase is 6% of a mass of the starch, and the other steps and operations are the same as in Embodiment 4.

Comparative Embodiment 1

The difference from Embodiment 3 is that the sulfur-fixing agent is a mixture of $Ca(HCO_3)_2$ and $Mg(HCO_3)_2$ in a mass ratio of 4:2, a total addition amount of the sulfur-fixing agent is the same as that in Embodiment 3, and the other steps and operations are the same as in Embodiment 3.

Comparative Embodiment 2

The difference from Embodiment 3 is that the sulfur-fixing agent is a mixture of $Ba(OH)_2$ and $Ca(HCO_3)_2$ in a mass ratio of 1:4, a total addition amount of the sulfur-fixing agent is the same as that in Embodiment 3, and the other steps and operations are the same as in Embodiment 3.

Comparative Embodiment 3

The difference from Embodiment 3 is that the sulfur-fixing agent is a mixture of $Ba(OH)_2$, $Ca(HCO_3)_2$ and $Ca(HCO_3)_2$ in a mass ratio of 8:1:1, a total addition amount of the sulfur-fixing agent is the same as that in Embodiment 3, and the other steps and operations are the same as in Embodiment 3.

Comparative Embodiment 4

The difference from Embodiment 3 is that the sulfur-fixing agent is $Ca(HCO_3)_2$, a total addition amount of the sulfur-fixing agent is the same as that in Embodiment 3, and the other steps and operations are the same as in Embodiment 3.

Comparative Embodiment 5

The difference from Embodiment 4 is that a mass ratio of β-amylase and isoamylase is 3:1, their addition amount is the same as that in Embodiment 4, and the other steps and operations are the same as in Embodiment 4.

Comparative Embodiment 6

The difference from Embodiment 4 is that a mass ratio of β-amylase and isoamylase is 1:3, their addition amount is the same as that in Embodiment 4, and the other steps and operations are the same as in Embodiment 4.

Comparative Embodiment 7

The difference from Embodiment 4 is that only β-amylase is used, its addition amount is the same as that in Embodiment 4, and the other steps and operations are the same as in Embodiment 4.

Comparative Embodiment 8

The difference from Embodiment 4 is that a particle size of the coal particles in step (3) is different, specifically: (3) crushing the coal for combustion, and screening to obtain coal particles, with an average particle size of the coal particles being 4 mm; and the other steps and operations are the same as in Embodiment 4.

Effect Detection:

Detection of Combustible Content and Sulfur Content in the Ash Obtained After Complete Combustion of Coal Blank sample (raw coal): The coal is crushed to a particle size range of 5-200 μm, without adsorption treatment.

Detection Method: The combustible content is determined according to DNL567.6-2016 using a drying oven+muffle furnace method, and the sulfur content is measured using the coulometric titration method as specified in DL/T567.7-2007. The detection results are shown in Table 1 below.

TABLE 1

| | Combustible content in fly ash | Combustible content in slag | Sulfur content in fly ash | Sulfur content in slag |
|---|---|---|---|---|
| Blank sample | 7.54% | 3.82% | 0.80% | 0.36% |
| Embodiment 1 | 1.52% | 0.95% | 1.08% | 0.72% |
| Embodiment 2 | 1.57% | 0.90% | 1.12% | 0.75% |
| Embodiment 3 | 1.35% | 0.88% | 1.10% | 0.73% |
| Comparative embodiment 1 | 1.36% | 0.90% | 0.95% | 0.52% |
| Comparative embodiment 2 | 1.37% | 0.92% | 0.92% | 0.61% |
| Comparative embodiment 3 | 1.35% | 0.90% | 0.94% | 0.58% |
| Comparative embodiment 4 | 2.82% | 1.25% | 0.88% | 0.46% |
| Embodiment 4 | 1.03% | 0.71% | 1.31% | 0.92% |
| Embodiment 5 | 1.05% | 0.73% | 1.28% | 0.86% |
| Embodiment 6 | 1.08% | 0.75% | 1.26% | 0.90% |
| Comparative embodiment 5 | 1.30% | 0.84% | 1.24% | 0.86% |
| Comparative embodiment 6 | 1.32% | 0.83% | 1.22% | 0.88% |
| Comparative embodiment 7 | 1.34% | 0.86% | 1.18% | 0.84% |
| Comparative embodiment 8 | 1.82% | 1.10% | 0.75% | 0.62% |

After coal combustion, in addition to gaseous combustion products, it generally also includes small particles of fly ash and large particles of slag. The higher the combustible content of fly ash and slag, the less complete the coal combustion is; the higher the sulfur content of fly ash and slag, the better the sulfur fixation effect is.

According to the test data in Table 1 above, in Embodiments 1-3 of the present disclosure, a mixture of $Ba(OH)_2$, $Ca(HCO_3)_2$, and $Mg(HCO_3)_2$ is used as a sulfur-fixing agent, which is dissolved in starch gelatinized solution. This starch solution is then adsorbed in situ onto coal particles, allowing the soluble sulfur-fixing agent to be uniformly adsorbed into the coal during combustion, thus significantly improving the combustion efficiency and sulfur fixation effect of the coal. In Embodiments 4-6, β-amylase and isoamylase with a mass ratio of 1:1 are added into the starch gelatinized solution, which enables better dispersion of the sulfur-fixing agent components in the starch gelatinized solution and increases its fluidity, further enhancing the combustion efficiency and sulfur fixation effect of the coal. In Comparative Embodiments 1-3, changing the ratio or type of sulfur-fixing agent has little impact on the combustion efficiency of coal but significantly affects the sulfur fixation effect. In Comparative Embodiment 4, replacing the sulfur-fixing agent with $Ca(OH)_2$ significantly affects the sulfur fixation effect of coal combustion. In Comparative Embodiments 5-7, altering the ratio or type of β-amylase and isoamylase affects the fluidity of the starch gelatinized solution, significantly impacting both the combustion efficiency and sulfur fixation effect of coal. In Comparative Embodiment 8, changing the particle size of coal particles significantly affects the adsorption efficiency of the sulfur-fixing agent by coal and the combustion efficiency, resulting in a weakened sulfur fixation effect.

The above embodiments are only used to illustrate the technical solutions of the present disclosure but not to limit them. Although the present disclosure has been described in detail with reference to the above embodiments, those of ordinary skill in the art can still make modifications or equivalent substitutions to the specific embodiments of the present disclosure. Any modifications or equivalent substitutions that do not depart from the spirit and scope of the present disclosure are within the scope of the claims of the present disclosure.

What is claimed is:

1. A preparation method of a clean coal for combustion, comprising the following steps:

(1) dispersing starch in water and uniformly stirring to obtain a starch milk with a concentration of 5-20 g/L; and heating the starch milk to 70-100° C. and gelatinizing for 10-60 minutes to obtain a starch gelatinized solution;

(2) adding a sulfur-fixing agent into the starch gelatinized solution under a condition of controlling a temperature of the starch gelatinized solution at 30-60° C., and centrifuging to remove insoluble substances to obtain the starch gelatinized solution containing the sulfur-fixing agent;

(3) crushing a coal for combustion, and screening to obtain coal particles; and (4) conveying the coal particles to a fluidized bed, spraying the starch gelatinized solution containing the sulfur-fixing agent on the coal particles in a suspension state, and drying to obtain coal particles adsorbed with the sulfur-fixing agent and gelatinized starch;

wherein the sulfur-fixing agent in the step (2) is a soluble sulfur-fixing agent;

and the soluble sulfur-fixing agent is one or more selected from the group consisting of $Ba(OH)_2$, $Ca(HCO_3)_2$ and $Mg(HCO_3)_2$; and in step (2), an amylase is further added, and an addition amount of the amylase is 3-6% of a mass of the starch.

2. The preparation method according to claim 1, wherein the soluble sulfur-fixing agent is a mixture of $Ba(OH)_2$, $Ca(HCO_3)_2$ and $Mg(HCO_3)_2$.

3. The preparation method according to claim 2, wherein a mass ratio of $Ba(OH)_2$, $Ca(HCO_3)_2$ and $Mg(HCO_3)_2$ is 1:2-5:1-3.

4. The preparation method according to claim 1, wherein a ratio of a mass of the soluble sulfur-fixing agent to a volume of the starch gelatinized solution in step (2) is 5-15:1 (g/L).

5. The preparation method according to claim 1, wherein the coal particles in step (3) have an average particle size of 5-200 μm.

6. The preparation method according to claim 1, wherein in step (4), the starch gelatinized solution containing the sulfur-fixing agent is uniformly sprayed onto the coal particles at room temperature in a ratio of 3‰-5‰.

7. The preparation method according to claim 1, wherein in step (4), a drying temperature is above 80° C.

8. The preparation method according to claim 1, wherein the amylase is one or more selected from the group consisting of α-amylase, β-amylase, glucoamylase and isoamylase.

9. The preparation method according to claim 8, wherein the amylase is a mixture of β-amylase and isoamylase at a mass ratio of 1:1.

* * * * *